United States Patent [19]

Cass

[11] 3,936,025

[45] Feb. 3, 1976

[54] EDGE PROTECTOR DEVICE

[76] Inventor: David L. Cass, 573 Isham St., New York, N.Y. 10034

[22] Filed: May 23, 1974

[21] Appl. No.: 473,079

[52] U.S. Cl. ..... 248/345.1

[51] Int. Cl.² ..... A47B 95/00

[58] Field of Search ..... 248/345.1

[56] References Cited

UNITED STATES PATENTS

| | | | |
|---|---|---|---|
| 2,603,909 | 7/1952 | Pettibone | 248/345.1 |
| 2,633,252 | 3/1953 | Friedman | 248/345.1 X |
| 2,995,863 | 8/1961 | Bright | 248/345.1 |
| 3,030,728 | 4/1962 | Wesman | 248/345.1 |
| 3,762,626 | 10/1973 | Dorsey | 248/345.1 |

*Primary Examiner*—George H. Krizmanich
*Attorney, Agent, or Firm*—John J. Hart

[57] ABSTRACT

The universal protector device herein is constituted of a unitary piece of soft, moldable, resilient material, and composed of two hingedly connected walls on one of which is provided an outer inwardly directed suction cup and an inner inwardly directed transverse cushioning rib and on the other wall of which are provided a plurality of inwardly directed longitudinally extending ribs. A substantially U-shaped inwardly directed rib extends along the side edges of said other wall and along the side and outer edges of said one wall.

6 Claims, 4 Drawing Figures

EDGE PROTECTOR DEVICE

THE INVENTION

This invention relates generally to devices for protecting children and adults from serious injuries that might be occasioned by accidental contact with the sharp corners or edges of furniture.

The primary purpose of the instant invention is to provide an improved protective device of the indicated type having such universality that it can be inconspicuously mounted on all types of furniture to afford protection against straight edges, corners, and other types of accident prone design work found on furniture.

Another object of the invention is to provide an improved protective device of such configuration that the possibility of anyone falling against it suffering a serious or scarring injury either to the eye or any other parts of the body, is quite remote.

Other objects of the invention as well as the advantages of the device thereof will appear from the following description, when read in connection with the accompanying drawings, in which FIG. 1 is a perspective view illustrating how the device of the invention may be mounted on a corner and edge of a piece of furniture;

Figure 1:
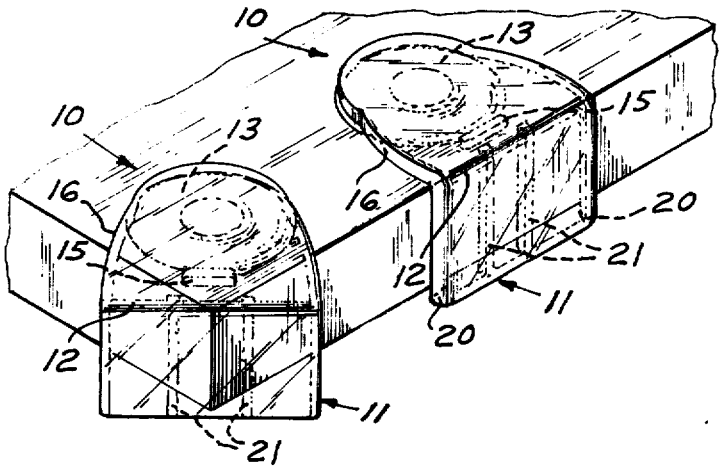
Figure 2:
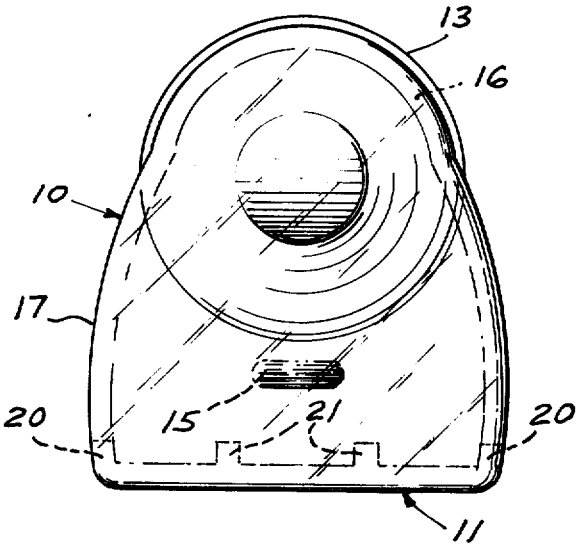
FIG. 2 is an elevational view of the side of the device shown in FIG. 1.

The protective device shown in the drawing is constituted of a moldable soft, supple and resilient material such as the thermoplastic resin polyvinylchloride so as to present no hazard to a person falling against it. Its special design protects children from harmful bumps and renders quite remote the likelihood of its penetrating the eye cavity of a person falling against. Its special design also enables the device of this invention to cover in addition to the usual furniture corners, the straight edges of furniture, as well as other different types of unusual shaped corners and edges.

The device is preferably injection molded to provide a unitary, one-piece article having a body composed of two integrally connected, angularly disposed, walls designated generally by the reference numerals 10 and 11. The two walls 10 and 11 are approximately ⅛ inch thick to assure the provision of sufficient of the rubber-like material in the device to produce the desired cushioning effect. At the juncture of the two walls, the inner faces thereof define an angle of at least 90°. The outer surface 12 of the device along the line of juncture of such walls is rounded to minimize injury to the portion of a person's body that might accidently contact the same. In the use of the protection device the wall 10 thereof is attached to a flat surface of the article so that the line of juncture of the walls 10 and 11 overlies the corner or the straight edge for which the device is to provide protection and with the wall 11 of the device freely overlying the meeting edges of the furniture surfaces forming the corner, or the other surface of the furniture forming such straight edge being protected, both of which methods of attachment are illustrated in FIG. 1 of the drawings.

Figure 3:
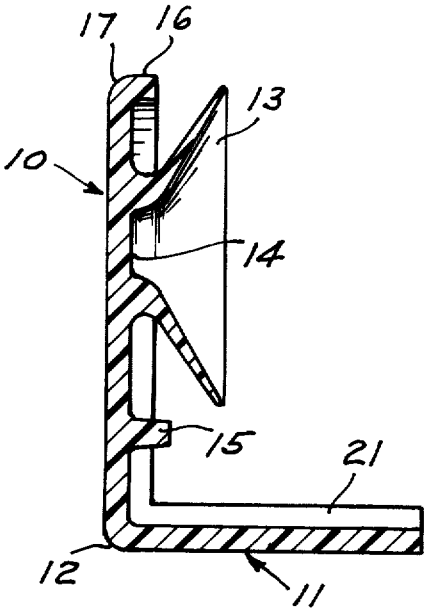
FIG. 3 is a vertical sectional view taken through the center of the device as shown in FIG. 2.
Figure 4:
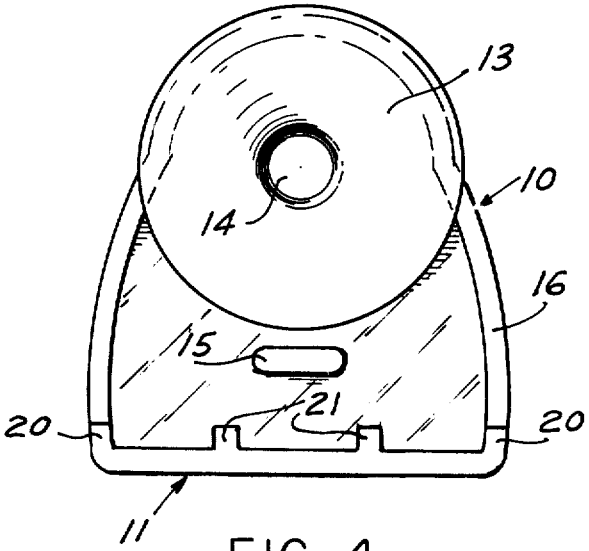
FIG. 4 is an elevational view of the other side of the device as shown in FIG. 2.

To enable such attachment of the wall 10, it has integrally molded to its inner face adjacent to the free end thereof, a plastic suction cup 13 configured to assure secure adhesion to any smooth, flat non-porous surface. The construction of the suction device is such that it is difficult for small children to remove the device once it has been attached to a piece of furniture. It will be noted from FIGS. 3 and 4 of the drawings, that the closed end of the suction cup 13 is formed by a portion 14 of the inner face of the wall 10. The base of the suction cup is frusto-conically shaped, and such base as well as the outer portion of the cup taper gradually to a relatively thin outer edge. Also integrally molded to the inner face of the wall 10 between the suction cup 13 and the joint between the two walls 10 and 11, is a projecting rib 15 approximately ⅛ inch wide and ½ inch long. The rib 15 is disposed transversely to the length of the wall 10 and is in substantial parallelism to the joint between the walls 10 and 11. The height of the rib 15 is approximately ¼ inch to enable its outer edge to contact the surface to which the suction cup 13 is adhered when the so secured wall 10 is in substantial parallelism with such surface. The wall 10 has further integrally molded thereto an inwardly projecting, substantially U-shaped, peripheral rib 16 extending around the entire length of the side and end free edges of such wall. It will be noted that at the outer free end of the wall 10, the rib 16 is semi-circularly-shaped and has a radius slightly less than that of the suction cup 13 so that it overlies in spaced relation approximately 180° of the outer edge portion of the suction cup. The depth of the rib 16 from the inner surface of the plate 10 and the width thereof are each approximately ⅛ inch so that such rib has a substantially square cross-sectional area. The outer free edges of the wall 10 at their juncture with the outer side surfaces of the rib 16 are rounded to provide a smooth protective edge 17.

It will be understood from the foregoing, that when the wall or plate 10 of the device is adhered to a furniture surface by the vacuum cup 13, such vacuum cup and the transverse rib 15 coact to provide a cushioning action against the blows that the plate 10 will receive as a result of a person falling against it. The soft rubber-like constitution of the material of such plate and the exterior rounded edges 12 and 17 around the entire perimeter of such plate minimize the possibility of any injury to the part of the persons body striking such plate 10. If the blow to the plate 10 is a slanting one or of unusual severity, the rib 16 around the edge of such plate will exercise a further cushioning action to soften the effects of such types of blows. In this manner, the device can protect a person against even very awkward and severe falls against the furniture piece on which the device is mounted.

The wall or plate 11 of the device has a thickness similar to that of the plate 10, i.e., about ⅛ inch thick. The side edges of the plate 11 are provided with inwardly directed straight ribs 20,20 which form continuations of the legs of the substantially U-shaped rib 16 on the plate 10. The outer side edges of the plate 11 at their juncture with the outer side surfaces of the ribs 20,20 are rounded to provide smooth protective side edges on such plate. Located between and extending in parallelism with the ribs 20,20 are two spaced ribs 21,21 projecting inwardly from the inner surface of plate 11. The ribs 21,21 have a width and depth similar to those of the ribs 16 and 20 and extend from the free end of plate 11 to the joint between the two plates 10 and 11. The inner ends of the ribs 21,21 are integrally formed with the interior surface of the plate 10. The ribs 21,21 are equally spaced from the ribs 20,20, and are spaced from each other a distance slightly greater than the length of the transverse rib 15 so that the latter can readily fit therebetween when the two plates or walls 10,10 are folded inwardly about the joint connecting them together.

It will be noted from FIG. 1 of the drawings, that when the device of this invention is mounted on a piece of furniture to protect a corner thereof, it is positioned on such furniture piece so that the corner thereof will be between the ribs 21,21. With the device so arranged thereon, the plates thereof will protect a person falling on or against such corner and the ribs 21,21 will coact with the furniture corner to maintain the device properly mounted on the furniture piece during such impact. When the device however, is mounted to protect a person against injury by a straight edge of the furniture both ribs 21,21 will cooperate with the side ribs 20,20 to provide a cushioning action against forces tending to crush the plate 11 against the flat surface of the furniture covered thereby. While the ribs 21,21 as a result of their connection at their inner ends tend to maintain the two plates or walls in angular relation they do not prevent flexture of such walls relative to each other to accommodate the device to different types of furniture surfacing. Thus, the free plate is connected in hinged relation to the anchored plate when the device is secured to a piece of furniture.

It is believed that it will be apparent from the above description that the device of the present invention is possessed of a universality which renders it equally effective to afford protection against possible injury from both the corners, the straight edges and any other types of sharp borders that may be provided on a piece of furniture. If desired a series of such devices can be arranged in side-by-side relation to afford protection against a long sharp edged section of a piece of furniture. Preferably, the device of this invention is made in a crystal clear transparent form so that it will be relatively inconspicuous on the portion of the piece of furniture it is affording protection against.

What is claimed is:

1. A unitary device universally adaptable as a protector against injury from corners, straight edges and other sharp borders of a piece of furniture, said device being formed of soft moldable resilient material and composed of two walls joined together at their inner edges to form an elongated joint adapted to lie across a corner or overlay a straight edge or other sharp border of a piece of furniture, said walls being disposed at approximately 90°, but capable of flexture relative to each other about said elongated joint, a first means provided on one of said walls for detachably securing such wall of the device to a surface of a piece of furniture with said elongated joint adapted to overlay a corner, straight edge or other sharp border of the furniture piece and the other of said walls adapted to overlay a part of the furniture piece disposed at an angle to such furniture surface, second means on said one wall between said securing means and said elongated joint adapted to engage said furniture surface when the device is attached thereto and to coact with said first securing means to exert a cushioning action against blows delivered to said one wall of the attached device, and third means on said other wall adapted to engage a part of the furniture piece and restrain displacement of said elongated joint relative to a furniture piece corner overlaid thereby under blows delivered to the device.

2. A device as claimed in claim 1, in which said first securing means comprises a suction cup depending from said one wall and located adjacent to the outer edge of such one wall in spaced relation to said elongated joint, and in which said second means comprises a cushioning member depending from the inner surface of said one wall in the space between said vacuum cup and said elongated joint and spaced from said vacuum cup and elongated joint.

3. A device as claimed in claim 1, in which said third means comprises a pair of spaced cushioning members projecting from the inner surface of said other wall and adapted to receive therebetween the part of the furniture engaged thereby.

4. A device as claimed in claim 1, in which said device is composed of only two walls, said one and other walls hingedly connected by said elongated joint, and includes an inwardly directed peripheral cushioning rib extending around the side and outer edges of said one wall and along the side edges of said other wall.

5. A device as claimed in claim 1, in which said device is composed of only two walls, said one and other walls hingedly connected by said elongated joint, in which said first securing means comprises a suction cup depending from said one wall and adapted to be compressed when attached to a furniture surface, in which said second means comprises a cushioning member depending from the inner surface of said one wall, in which said third means comprises a pair of spaced cushioning members projecting from the inner surface of said other wall and adapted to receive therebetween the part of the furniture engaged thereby, and including cushioning peripheral edge portions projecting inwardly from the peripheral edges of said one and other walls.

6. A device as claimed in claim 5, in which said cushioning member constituting said second means projects from the inner surface of said one wall a distance approximating the height of said suction cup in the compressed attached condition thereof and greater than the distance of projection of said peripheral edge portions of said one wall, and in which said pair of cushioning members constituting said third means are composed of a pair of spaced ribs extending transversely to said elongated joint and located between and spaced from said peripheral edge portions of said other wall.

* * * * *